US007690645B2

(12) United States Patent
Koga

(10) Patent No.: US 7,690,645 B2
(45) Date of Patent: Apr. 6, 2010

(54) SHEET SUPPLYING APPARATUS

(75) Inventor: Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 358 days.

(21) Appl. No.: 11/339,663

(22) Filed: Jan. 26, 2006

(65) Prior Publication Data

US 2006/0164501 A1 Jul. 27, 2006

(30) Foreign Application Priority Data

Jan. 26, 2005 (JP) ..... 2005-018128

(51) Int. Cl.
*B65H 3/34* (2006.01)

(52) U.S. Cl. ..... 271/167; 271/145; 271/121

(58) Field of Classification Search ..... 271/121, 271/145, 167

See application file for complete search history.

(56) References Cited

U.S. PATENT DOCUMENTS

| | | | | |
|---|---|---|---|---|
| 5,879,003 | A * | 3/1999 | Kovach et al. | 271/121 |
| 5,895,040 | A * | 4/1999 | Oleksa et al. | 271/124 |
| 6,279,897 | B1 * | 8/2001 | Richards | 271/121 |
| 6,375,183 | B1 | 4/2002 | Inoue et al. | |
| 6,536,757 | B2 * | 3/2003 | Chang | 271/16 |
| 6,616,138 | B2 * | 9/2003 | Tanaka | 271/124 |
| 6,712,351 | B2 * | 3/2004 | Hsieh | 271/121 |
| 6,883,798 | B2 * | 4/2005 | Hsieh | 271/124 |
| 7,066,461 | B2 * | 6/2006 | Asada | 271/121 |
| 7,108,257 | B2 * | 9/2006 | Shiohara et al. | 271/104 |
| 2001/0002077 | A1 * | 5/2001 | Chua et al. | 271/121 |
| 2004/0017039 | A1 * | 1/2004 | Asada et al. | 271/121 |

(Continued)

FOREIGN PATENT DOCUMENTS

JP H05-010349 U 2/1993

(Continued)

OTHER PUBLICATIONS

Japanese Patent Office, Notification of Reason for Refusal for Japanese Patent Application No. 2005-018128 (counterpart to above-captioned patent application), mailed Dec. 3, 2008.

*Primary Examiner*—Patrick H Mackey
*Assistant Examiner*—Prasad V Gokhale
(74) *Attorney, Agent, or Firm*—Baker Botts L.L.P.

(57) ABSTRACT

A sheet supplying apparatus, including a sheet holder which accommodates recording sheets stacked on each other; a feeding device which feeds an uppermost one of the stacked sheets in a sheet-feed direction; an inclined guide plate which is provided downstream of the sheet holder in the sheet-feed direction, wherein the inclined guide plate has a sheet-guide surface which guides a movement of each sheet while changing a direction of the movement thereof; a sheet-separate body with which the sheet feeding device cooperates to separate and feed the sheets, one by one, wherein the sheet-separate body is supported by the inclined guide plate, and includes sheet-separate portions which are arranged in the sheet-feed direction and which project from respective portions of the sheet-guide surface; and a projecting portion which is supported by the inclined guide plate, at a position distant from the sheet-separate body in a widthwise direction of the sheet holder, and which has a curved surface projecting from the sheet-guide surface.

19 Claims, 15 Drawing Sheets

U.S. PATENT DOCUMENTS

| | | | | |
|---|---|---|---|---|
| 2004/0026845 | A1* | 2/2004 | Park | 271/167 |
| 2004/0032077 | A1* | 2/2004 | Oh et al. | 271/121 |
| 2004/0065992 | A1* | 4/2004 | Youn | 271/121 |
| 2004/0084831 | A1* | 5/2004 | Asada | 271/10.01 |
| 2004/0245703 | A1* | 12/2004 | Yun et al. | 271/110 |
| 2004/0251592 | A1* | 12/2004 | Ruhe et al. | 271/109 |
| 2005/0133981 | A1* | 6/2005 | Mitsuhashi | 271/121 |

FOREIGN PATENT DOCUMENTS

| | | | |
|---|---|---|---|
| JP | 2001199578 | | 7/2001 |
| JP | 2002173240 | | 6/2002 |
| JP | 2004-149297 | A | 5/2004 |
| JP | 2004149297 | | 5/2004 |
| JP | 2005-008416 | A | 1/2005 |

* cited by examiner

SHEET SUPPLYING APPARATUS

The present application is based on Japanese Patent Application No. 2005-018128 filed on Jan. 26, 2005, the contents of which are incorporated herein by reference.

BACKGROUND OF THE INVENTION

1. Field of the Invention

The present invention relates to a sheet supplying apparatus that includes a sheet holder in which a plurality of recording sheets are stacked on each other; a sheet feeding device; and a sheet-separate body, and that supplies, to a recording device, the recording sheets, one by one, while separating the sheets from each other.

2. Discussion of Related Art

There is known an image recording apparatus, such as a printer, a copier, or a facsimile machine, that includes a sheet supplying device for supplying, to an image recording portion of the apparatus, a plurality of cut sheets each as a recording medium, one by one, while separating each one of the cut sheets from the remaining cut sheets.

For example, Patent Document 1 (i.e., Japanese Patent Application Publication No. 2002-173240) discloses a sheet supplying device including an upwardly open, sheet cassette that accommodates a plurality of cut sheets in a substantially horizontally stacked state; a plurality of inclined sheet-separate plates that are provided at a downstream end of the sheet cassette as seen in a sheet-feed direction in which each cut sheet is fed, such that the inclined sheet-separate plates are distant from each other by respective appropriate distances in a widthwise direction of each cut sheet; a sheet-feed roller that is provided above the sheet cassette, is pressed against the uppermost one of the stacked cut sheets, and is driven or rotated to feed the uppermost cut sheet; and a U-turn path (i.e., a U-shaped sheet guide) that cooperates with the sheet-feed roller and the inclined sheet-separate plates to separate the uppermost cut sheet from the remaining cut sheets and feed the separated cut sheet to an image recording portion provided above the sheet cassette.

In addition, Patent Document 2 (i.e., Japanese Patent Application Publication No. 2004-149297 or its corresponding U.S. Patent Application Publication No. 2004-084831) discloses a sheet supplying device including an inclined wall on which a plurality of cut sheets are placed in a stacked state such that the cut sheets are inclined obliquely downward; a bottom plate that is provided below the inclined wall, has an obtuse angle with respect to an upper surface of the inclined wall, and extends in a widthwise direction of each cut sheet; and a sheet-feed roller that is pressed against the uppermost one of the cut sheets stacked on the inclined wall and feeds the uppermost cut sheet. The bottom plate is provided with a sheet-separate portion formed of a stainless steel. The sheet-separate portion includes a plurality of projecting portions that are arranged, in a sheet-feed direction in which each cut sheet is fed, such that the projecting portions are distant from each other by a regular interval of distance; a plurality of arm portions each of which supports a corresponding one of the projecting portions, on either side of the one projecting portion; and a continuous base portion that continuously connects the arm portions to each other and thereby supports the arm portions. The sheet-separate portion is held by a holder that is formed of a metallic sheet and is fixed to the bottom plate, such that the projecting portions project by a predetermined amount through an elongate hole of the holder that is elongate in the sheet-feed direction. When the sheet-feed roller, pressed against the uppermost one of the stacked cut sheets, is driven or rotated to feed the uppermost cut sheet, a lower end of the uppermost cut sheet presses each one of the projecting portions, and consequently the each projecting portion is moved downward into the elongate hole of the holder because of elastic deformation of the corresponding arm portion. Since, however, the remaining cut sheets are not moved because respective lower ends thereof are engaged with the other projecting portions that remain projecting from the elongate hole, only the uppermost cut sheet can be separated from the other cut sheets and fed forward.

Generally, in an image recording apparatus, a recording portion is provided in a space above a sheet tray or cassette, for the purpose of reducing a footprint of the apparatus, and the recording portion and the sheet cassette are connected to each other by a sheet reversing and conveying guide (i.e., a U-turn sheet guide) that is constituted by a pair of guide members. This image recording apparatus is disclosed by, e.g., Patent Document 1.

The sheet reversing and conveying guide has, in a sheet-reverse portion thereof where a direction of movement of each cut sheet is reversed, two sheet-convey rollers that cooperate with each other to nip a leading end portion of the uppermost cut sheet that has been fed forward by the sheet-feed roller and has been separated by the inclined sheet-separate plates. However, when the sheet-convey rollers starts nipping the leading end portion of the uppermost cut sheet, no drive force is transmitted to the sheet-feed roller any more, so that the sheet-feed roller is freely rotated. On the other hand, the sheet-convey rollers starts applying a conveying force to the cut sheet, so that the leading end portion of the cut sheet is forced to contact two register rollers provided in front of the recording portion, i.e., on an upstream side of the recording portion as seen in the sheet-convey direction. Therefore, even if the position of the cut sheet may be deviated from a correct position, the deviation can be corrected, i.e., registered.

After the sheet-convey rollers start nipping the leading end portion of the cut sheet, the cut sheet that has been forcedly fed forward while contacting the inclined sheet-separate plates and an outer one of the two guide members, then contacts the outer guide member because of only a shape restoring force of the cut sheet itself. Therefore, a recording surface of the cut sheet can be prevented from being damaged.

However, in the case where a power transmission device that transmits power to the sheet-convey rollers is omitted, or in the case where the sheet-convey rollers are omitted for the purpose of reducing a production cost of the sheet supplying apparatus, the sheet-feed roller needs to feed and convey the cut sheet till the leading end of the cut sheet is nipped by the register rollers. In each case, therefore, the recording surface of the cut sheet is forcedly engaged with the outer guide member, so that the recording surface may be easily damaged.

In particular, in the case where the cut sheet is a glossy sheet that is suitable for recording of a photographic image and exhibits a strong shape-restoring force, the cut sheet receives a great resisting force from the outer guide member, so that a recording surface of the cut sheet may be easily damaged. In addition, if a radius of curvature of the sheet reversing and conveying guide is small, this tendency is increased. Moreover, in the case where projecting portions as sheet-separate portions that are formed of metallic sheet are so disposed as to project from an inclined sheet-separate plate, for the purpose of reliable separation of each cut sheet from the remaining cut sheets, a deep scar may occur to the recording surface of the glossy sheet.

SUMMARY OF THE INVENTION

In the above-described technical background, the present invention has been developed. It is therefore an object of the present invention to provide a sheet supplying apparatus that is free of at least one of the above-indicated problems. It is another object of the present invention to provide a sheet supplying apparatus that can supply a recording sheet with a high sheet-separation performance, without damaging a recording surface of the recording sheet, According to a first aspect of the present invention, there is provided a sheet supplying apparatus, comprising a sheet holder which has a bottom wall and accommodates a plurality of recording sheets stacked on each other on the bottom wall; a feeding device which feeds an uppermost one of the stacked recording sheets in a sheet-feed direction; an inclined guide plate which is provided downstream of the sheet holder in the sheet-feed direction, wherein the inclined guide plate has a sheet-guide surface which guides a movement of each of the recording sheets while changing a direction of said movement; a sheet-separate body with which the sheet feeding device cooperates to separate and feed the recording sheets, one by one, wherein the sheet-separate body is supported by the inclined guide plate, and includes a plurality of sheet-separate portions which are arranged in the sheet-feed direction and which project from a plurality of portions of the sheet-guide surface of the inclined guide plate; and at least one projecting portion which is supported by the inclined guide plate, at at least one position distant from the sheet-separate body in a widthwise direction of the sheet holder, and which has a curved surface projecting from the sheet-guide surface of the inclined guide plate. The sheet holder may be an upstream portion in the sheet-feed direction of a sheet cassette that is detachably set in the sheet supplying apparatus, or an upstream portion in the sheet-feed direction of a sheet tray that is not detachable from the apparatus. The sheet supplying apparatus may employ a single projecting portion, or a plurality of projecting portions including two projecting portions provided on either side of the sheet-separate body.

In the present sheet supplying apparatus, the sheet-separate portions of the sheet-separate body are arranged in the obliquely upward direction, and project from the portions of the sheet-guide surface of the inclined guide plate that have different height positions; and the at least one projecting portion is supported by the inclined guide plate, at at least one position distant from the sheet-separate body in the widthwise direction of the sheet holder, and has the curved surface projecting from the sheet-guide surface such that an amount of projection of the curved surface increases in the obliquely upward direction. Therefore, each of the recording sheets stacked on each other in the sheet holder can be reliably separated from the remaining sheets and smoothly fed forward, while a trailing end portion of the each sheet is effectively prevented by the projecting portion from being strongly pressed against the sheet-separate portions.

According to a preferred feature of the first aspect of the present invention, the sheet supplying apparatus further comprises a curved sheet guide which is provided downstream of the inclined guide plate and which guides the movement of said each recording sheet, while cooperating with the sheet feeding device and the inclined guide plate to change the direction of the movement of said each recording sheet.

According to a second aspect of the present invention, there is provided a recording apparatus, comprising the sheet supplying apparatus according to the above-described preferred feature; and a recording device which records an image on each of the recording sheets. The present recording apparatus enjoys the same advantages as those of the sheet supplying apparatus according to the first aspect of the invention.

According to a third aspect of the present invention, there is provided a sheet cassette for accommodating a plurality of recording sheets stacked on each other, comprising a bottom wall on which the recording sheets are stacked on each other; an inclined guide plate provided at a downstream end of the sheet cassette in a sheet-feed direction in which each of the recording sheets is fed by a sheet feeding device and which is parallel to the bottom wall, wherein the inclined guide plate is inclined upward from the bottom wall, and wherein the inclined guide plate has a sheet-guide surface which guides a movement of said each recording sheet while changing a direction of said movement to an obliquely upward direction; a sheet-separate body which is supported by the inclined guide plate and includes a plurality of sheet-separate portions which are arranged in the obliquely upward direction and which project from a plurality of portions of the sheet-guide surface of the inclined guide plate that have different height positions; and at least one projecting portion which is supported by the inclined guide plate, at at least one position distant from the sheet-separate body in a widthwise direction of the sheet cassette, and which has a curved surface projecting from the sheet-guide surface of the inclined guide plate. The present sheet cassette enjoys the same advantages as those of the sheet supplying apparatus according to the first aspect of the invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFER EMBODIMENTS

Figure 1:
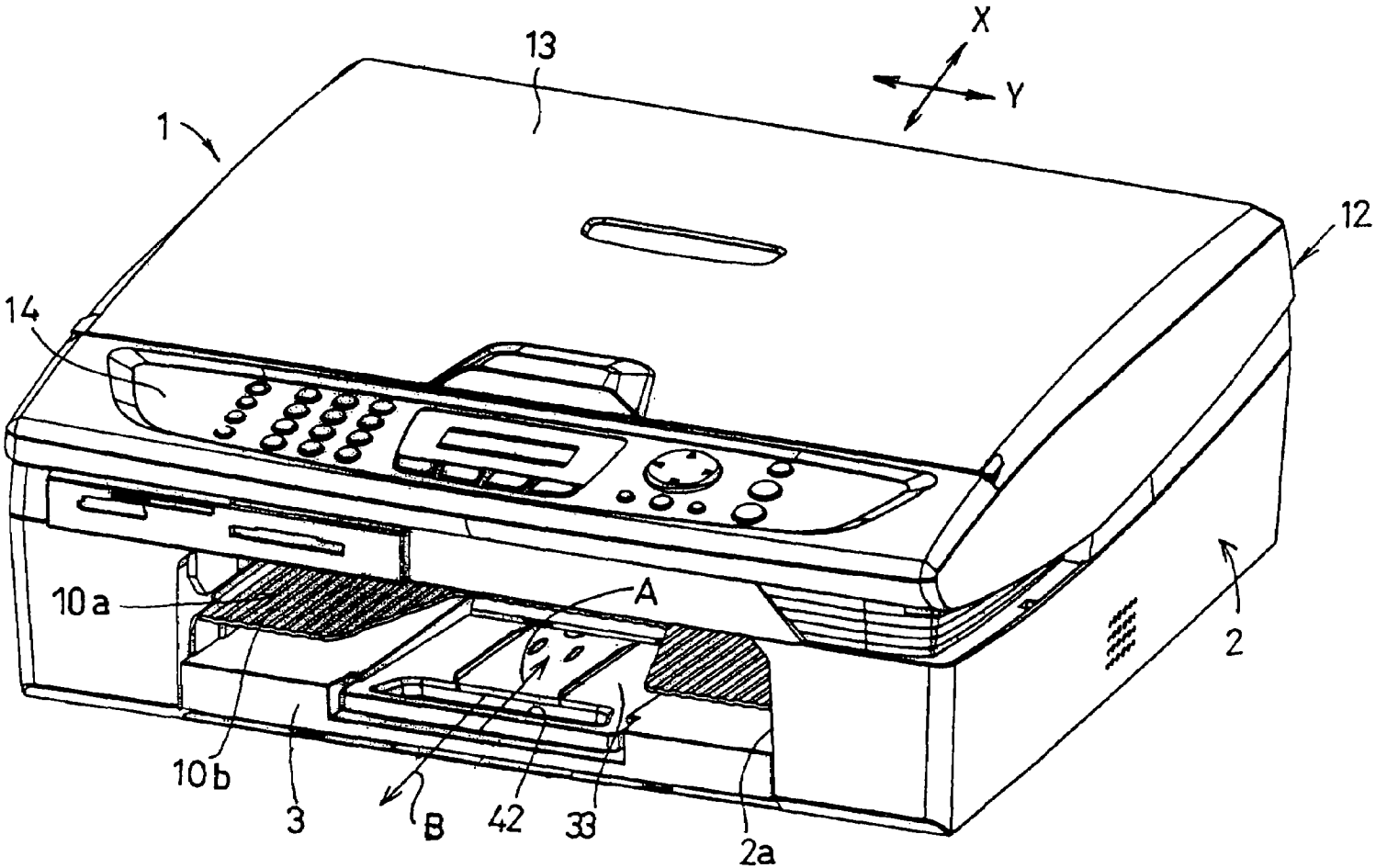
FIG. 1 is a perspective view of an image recording apparatus including a recording device and a sheet supplying apparatus, to which the present invention is applied.
Figure 2:
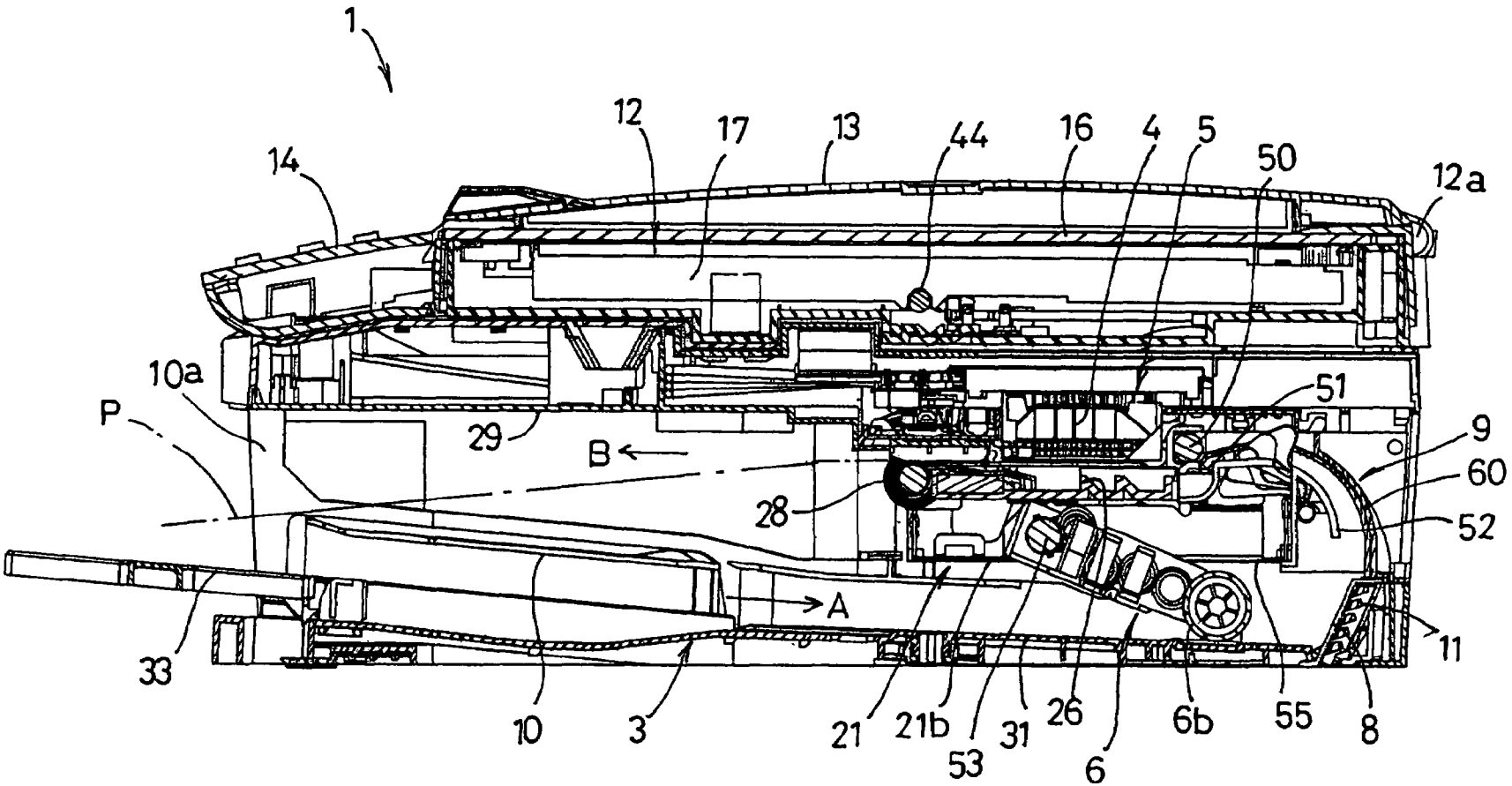
FIG. 2 is a cross-sectional view of the image recording apparatus.
Figure 3:
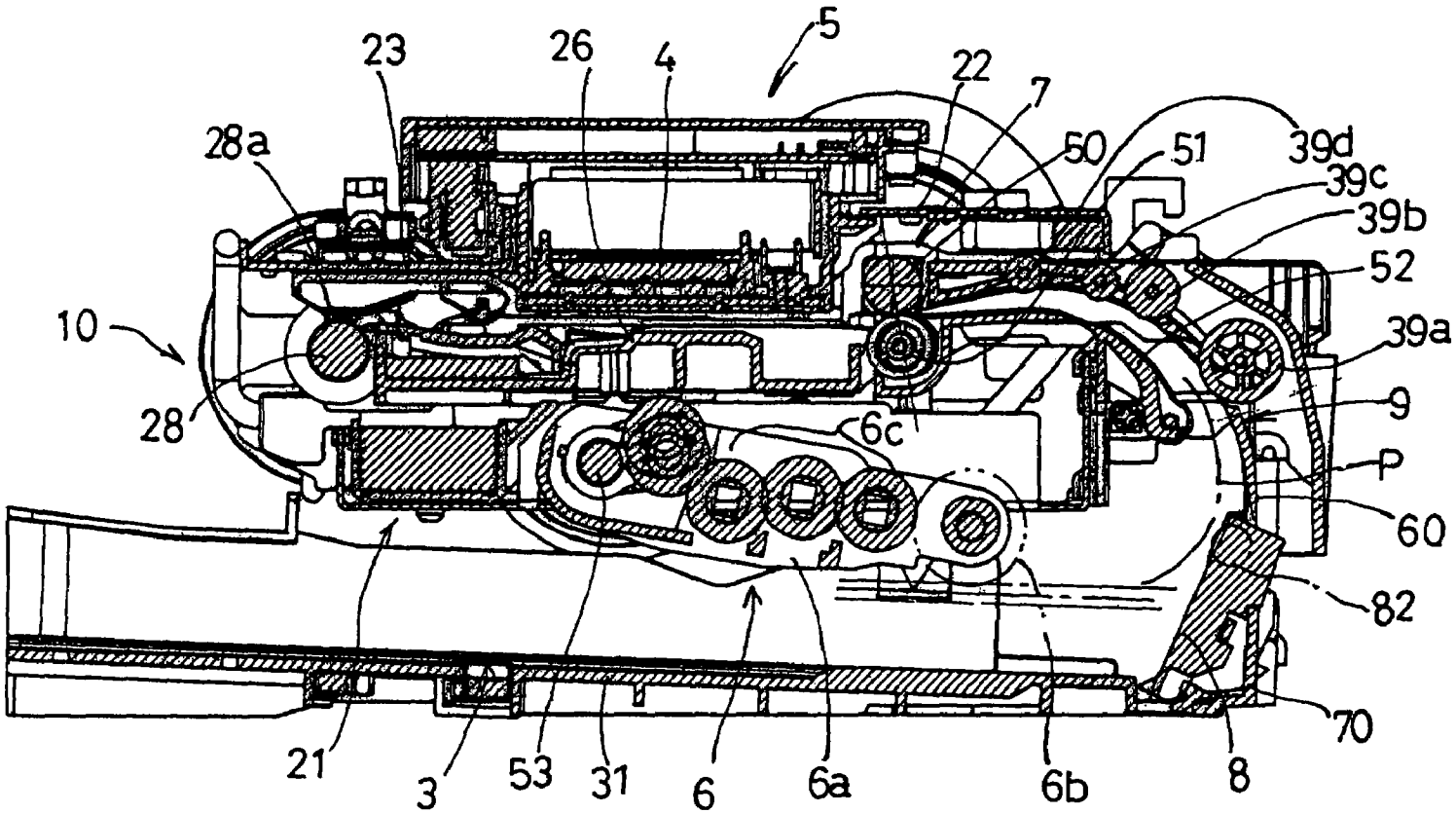
FIG. 3 is an enlarged cross-sectional view of the sheet supplying apparatus and the recording device of the image recording apparatus.
Figure 4:
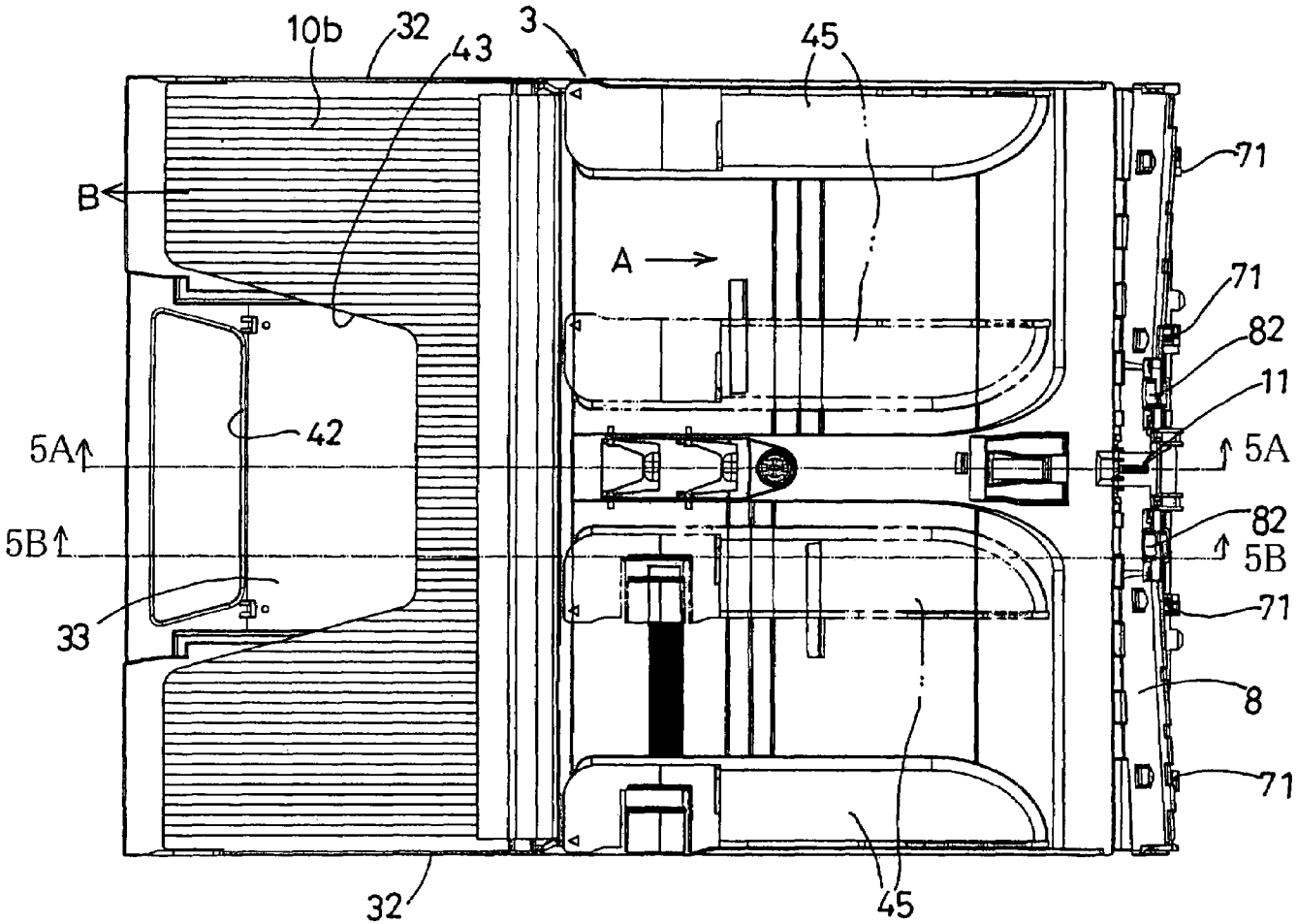
FIG. 4 is a plan view of a sheet cassette (i.e., a sheet holder) of the image recording apparatus.
Figure 5A:
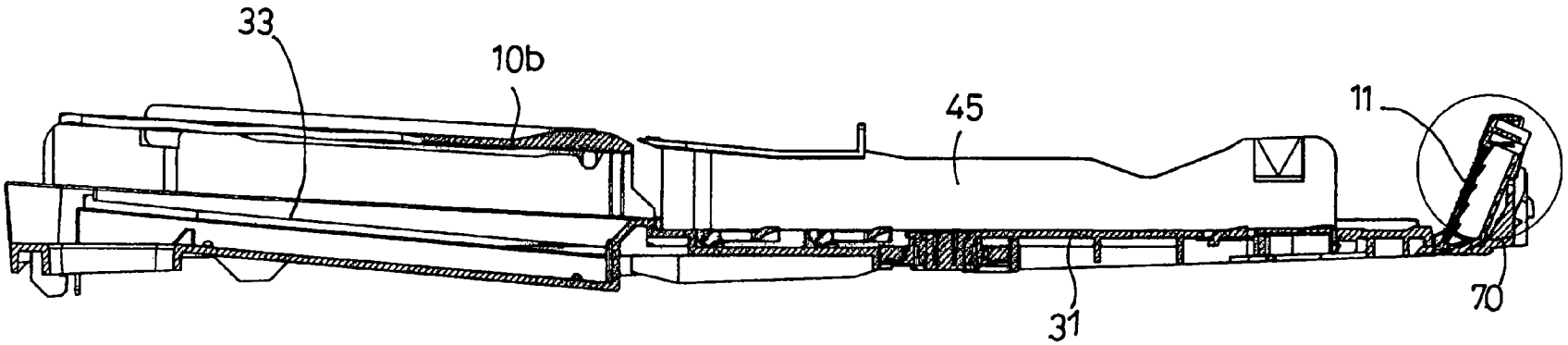
FIG. 5A is a cross-sectional view, taken along 5A, 5A in FIG. 4.
Figure 5B:
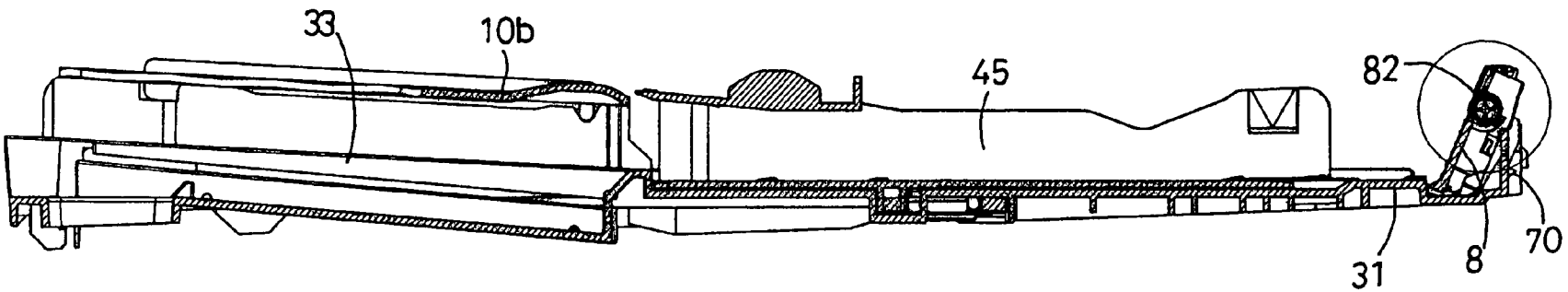
FIG. 5B is a cross-sectional view, taken along 5B, 5B in FIG. 4.

Hereinafter, there will be described preferred embodiments of the present invention by reference to the drawings. FIGS. 1 and 2 show an image recording apparatus 1 including an inkjet-type recording head 4, to which the present invention is applied. FIG. 3 shows a sheet supplying apparatus and an image recording device 7. FIGS. 4, 5A, and 5B show a sheet cassette 3. FIGS. 6, 7, 8, 9, 10, 11, and 12 show an inclined sheet-separate plate 8. FIG. 13 shows a sheet-separate body 11.

The image recording apparatus 1 is a so-called "multi function device (MFD)" that has a printer function, a copier function, a scanner function, and a facsimile-machine function. As shown in FIGS. 1 and 2, the image recording apparatus 1 includes a housing 2 that is formed by injection molding of a synthetic resin and constitutes a main frame or body of the recording apparatus 1.

In a top portion of the housing 2, there is provided an image reading device 12 that is used for each of the copier function and the facsimile-machine function. The image reading device 12 is constructed such that the reading device 12 is pivotable about an axis portion, not shown, located along one side of the housing 2, so that the reading device 12 can be opened upward and closed downward. A cover member 13 that can cover an original sheet having an original image and placed on an upper surface of the image reading device 12, is attached to the reading device 12 such that a rear end of the cover member 13 is pivotable about an axis portion 12*a* located along a rear end of the reading device 12, so that the cover member 13 can be opened upward and closed downward.

In the top portion of the housing 2, an operation panel 14 is also provided in front of the image reading device 12. The operation panel 14 includes various sorts of operation keys and a liquid-crystal display, as shown in FIG. 1. The image reading device 12 includes an original-sheet support glass plate 16 that supports, on the upper surface thereof, the original sheet and can be covered by the cover member 13 that can be opened upward to allow the original sheet to be placed on the glass plate 16. A contact image sensor (CIS) 17 is provided below the support glass plate 16, such that the image sensor 17 can be reciprocated along a guide shaft 44 in a main scanning direction, i.e., a Y direction in FIG. 1, so as to read the original image from the original sheet. The Y direction is perpendicular to the drawing sheet of FIG. 2.

An ink storing portion, not shown, of the image recording apparatus 1 accommodates a plurality of ink cartridges that store a plurality of color inks, e.g., black (Bk), cyan (C), magenta (M), and yellow inks (Y). The ink cartridges are connected to the recording head 4 of the image recording device 7 via respective flexible ink-supply tubes, not shown.

In a lower (or a bottom) portion of the housing 2, there is provided a sheet cassette 3 that is detachably inserted into an opening 2*a* located in a front-side portion of the housing 2, i.e., a left-side portion of the housing 2 as seen in FIG. 2. The sheet cassette 3 has a construction assuring that the cassette 3 can accommodate a plurality of cut recording sheets P each as a recording medium, such as A4-size sheets, legal-size sheets, letter-size sheets, or postcard-size sheets, such that the recording sheets P are stacked on each other and respective short sides of the sheets P extend in a direction (i.e., the direction perpendicular to the drawing sheet of FIG. 2, the main scanning direction, or the Y direction) perpendicular to a sheet-feed direction (i.e., a sub-scanning direction or an X direction).

As shown in FIGS. 2 through 5, the sheet cassette 3 as a portion of the sheet supplying apparatus includes a bottom plate (i.e., a bottom wall) 31 on which the recording sheets P are stacked on each other; and two side plates 32, 32 that extend upward from an upstream-side portion of the bottom plate 31 as seen in the sheet-feed direction, indicated by arrow "A". A sheet-discharge tray 10*b* is detachably attached to the two side plates 32, 32, such that the tray 10*b* bridges the two side plates 32, 32 and partially covers respective upstream-side portions of the recording sheets P, placed on the bottom plate 31, as seen in the sheet-feed direction A. The sheet-discharge tray 10*b* has, in a widthwise middle portion of a downstream-side end portion thereof as seen in a sheet-discharge direction, indicated by arrow "B", a generally U-shaped recessed portion 43 in its plan view that allows a user to insert easily new recording sheets P onto the bottom plate 31.

The sheet cassette 3 additionally includes two sheet-width guides 45 that are provided in a downstream-side portion thereof in the sheet-feed direction A and that are movable toward, and away from, each other in a widthwise direction of the cassette 3 and cooperate with each other to set or position the recording sheets P such that each of the sheets P is symmetrical with respect to a longitudinal centerline of the cassette 3 that is parallel to the sheet-feed direction A.

The sheet cassette 3 additionally includes an auxiliary support member 33 that is provided in a widthwise middle portion of an upstream-side end portion of the cassette 3 in the sheet-feed direction A and that has a generally plate-like shape. The auxiliary support member 33 is movable or slideable outward from the upstream-side end portion of the cassette 3, i.e., downstream as seen in the sheet-discharge direction B. The auxiliary support member 33 has, in a rear end portion thereof, an opening 42 that is formed through a thickness of the member 33 and through which the member 33 can be grasped by the user. When the user draws the auxiliary support member 33 outward while grasping the member 33 through the opening 42, the auxiliary support member 33 can support respective upstream-side end portions of the recording sheets P in the sheet-feed direction A that project outward from the upstream-side end portion of the bottom plate 31. FIG. 2 shows a state in which the auxiliary support member 33 is held at a drawn position thereof where a portion of the support member 33 projects out of the housing 2.

In addition, the sheet cassette 3 has, in a rear end portion thereof (i.e., a right-hand end portion in FIG. 2), an inclined sheet-separate plate (i.e., an inclined sheet guide plate) 8 that supports a sheet-separate body 11 that separates a leading end of each recording sheet P from the other recording sheets P. The inclined sheet-separate plate 8 is attachable and detachable to and from the cassette 3, without using a tool. In addition, an arm 6*a* of a sheet feeding device 6 is connected, at an upper end portion thereof, to the housing 2 such that the arm 6*a* is pivotable upward and downward, and a sheet-fee roller 6*b* is supported by a lower end portion of the arm 6*a*, and is driven or rotated by a drive source, not shown, via a transmission device (i.e., a gear device) 6*c* (FIG. 3) provided in the arm 6*a*. The sheet feeding device 6 cooperates with the sheet-separate body 11 to separate and feed, one by one, the recording sheets P (i.e., the recording media) stacked on each other in the sheet cassette 3, i.e., separate the top sheet P from the remaining sheets P and feeds the separated sheet P out of the cassette 3. The separated sheet P is fed via a curved sheet guide 9 defining a U-turn path that is initially oriented upward and then frontward toward the recording device 7 provided at a position higher than the sheet cassette 3. The curved sheet guide 9 is defined by, and between, a first guide member 60 located on an outer side of the U-turn path; and a second guide member 52 that is located on an inner side of the U-turn path. The first guide member 60 supports a plurality of (e.g., four) guide rollers 39*a*, 39*b*, 39*c*, 39*d* (FIG. 3) that are located in a downstream-side portion thereof in a sheet-convey direction and are near to two register rollers 50, 51. The curved sheet guide 9 is so constructed as to be able to center each recording sheet P such that a longitudinal centerline of the each sheet P is aligned with a longitudinal centerline of the U-turn path that is parallel to the sheet-convey direction.

As shown in FIGS. 2, 3, and 4, the recording device 7 is provided between a box-like frame 21, and a first and a second elongate plate-like guide members 22, 23 that are respectively supported by two side walls of the frame 21 and extend in the Y direction (i.e., the main scanning direction). The first guide member 22 is located on an upstream side of the second guide member 23 in the sheet-convey direction. The recording device 7 includes a carriage 5 that carries an inkjet-type recording head 4, and bridges the two guide members 22, 23 such that the carriage 5 is slideable and reciprocateable on the same 22, 23.

A timing belt, not shown, is fixed to an upper surface of the second guide member 23, located on the downstream side in the sheet-convey direction, such that the timing belt extends in the main scanning direction (i.e., the Y direction) and is driven to reciprocate the carriage 5. A carriage (CR) motor, not shown, that drives the timing belt is fixed to a lower surface of the second guide member 23.

A flat platen 26 extends in the Y direction such that the platen 26 is opposed to the lower surface of the recording head 4 that is moved by the carriage 5, and the platen 26 is fixed to the frame 21 at a position between the first and second guide members 22, 23, as shown in FIGS. 2 and 3.

A drive roller 50 and a follower roller 51 as the two register rollers are provided on an upstream side of the platen 26, and cooperate with each other to pinch and feed each recording sheet P to a space below the lower surface of the recording head 4. The follower roller 51 is provided bellow the drive roller 50, and is opposed to the same 50. On a downstream side of the platen 26, there are provided a sheet-discharge roller 28 that is driven to convey each recording sheet P on which an image has been recorded, to a sheet-discharge portion 10; and a spur roller 28*a* that is opposed to the discharge roller 28 and is biased toward the same 28.

The sheet-discharge portion 10 receives each recording sheet P having, on the upper surface thereof, the image recorded by the recording device 7. The sheet-discharge portion 10 is provided above the sheet cassette 3, and includes a sheet-discharge opening 10*a* that opens together with the cassette-insertion opening 2*a* in the front surface of the housing 2. An upper end of the sheet-discharge portion 10 is defined by a partition plate (i.e., a lower cover body) 29 that is formed of a synthetic resin as an integral portion of the housing 2 and that extends from the lower surface of the downstream-side, second guide member 23 to the sheet-discharge opening 10*a* provided in the front surface of the housing 2, as shown in FIG. 2.

Next, a construction of the sheet feeding device 6 will be described by reference to FIGS. 2 and 3. As described above, the sheet feeding device 6 includes the synthetic-resin-based frame-like arm 6*a*; and the sheet-feed roller 6*b* that is rotatably supported by the free end (i.e., the lower end) of the arm 6*a* and whose outer circumferential surface is defined by an annular member (e.g., a rubber member) having a high friction coefficient. The sheet feeding device 6 additionally includes a drive axis member 53 that is formed of a synthetic resin and whose end portion is supported by the base end of the arm 6*a* such that the drive axis member 53 is rotatable. Therefore, when the drive axis member 53 is driven or rotated, the sheet-feed roller 6*b* is rotated in a sheet-feed direction via the transmission device 6*c* including a series of gears. The transmission device 6*c* includes a first gear that is rotated as an integral portion of the drive axis member 53; a second, planetary gear that is rotatably supported by a free end portion of a planetary arm rotatably fitting on the drive axis member 53 and is meshed with the first gear; and a plurality of (e.g., three) third, intermediate gears that cooperate with each other to transmit power from the planetary gear to a gear fixed to the sheet-feed roller 6*b*.

The drive axis member 53 that is driven by a drive motor, not shown, is freely rotatably supported by the frame 21, and a free end of the axis member 53 is inserted into the base portion of the arm 6*a* of the sheet feeding device 6. A base end portion of the arm 6*a* is located in an opening 55 formed through a thickness of a bottom plate 21*b* of the frame 21. Thus, the arm 6*a* and the drive axis member 53 are supported by respective axis-support holes of two axis-support plates, not shown, such that the arm 6*a* and the axis member 53 are concentric with each other and are rotatable. A biasing device (e.g., a torsion spring), not shown, biases the sheet-feed roller 6*b* in a downward direction.

The arm 6*a* includes, as an integral portion thereof, a contact portion, not shown, that is located below the drive axis member 53 and extends along an axis line of the axis member 53 and that can slideably contact a cam surface as an upper surface of one of the two sheet-width guides 45. Therefore, when the sheet cassette 3 is inserted into, and drawn from, the bottom portion of the housing 2, the cam surface of the one sheet-width guide 45 engages the contact portion of the arm 6*a*, and thereby moves the arm 6*a* and the sheet-feed roller 6*b*, upward or downward. Thus, the arm 6*a* and the roller 6*b* are prevented from being interfered with by an upper end portion of the inclined sheet-separate plate 8 as the rear end wall of the cassette 3.

Figure 13:
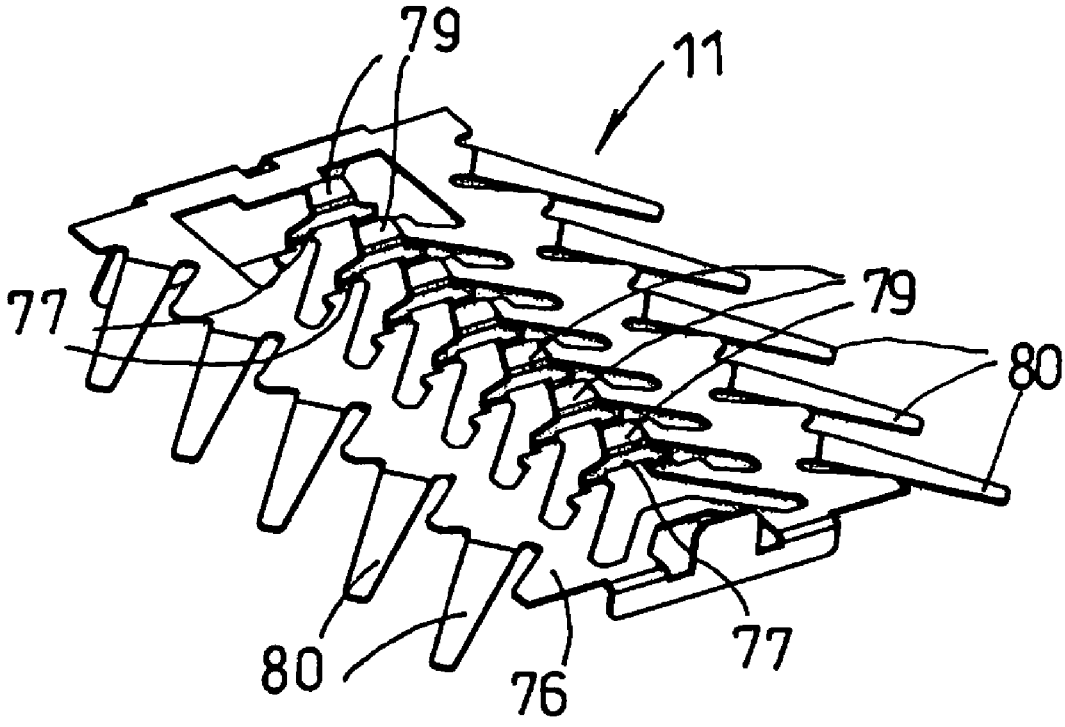
FIG. 13 is a perspective view of a front surface of a sheet-separate body attached to the inclined sheet-separate plate.
Figure 14:
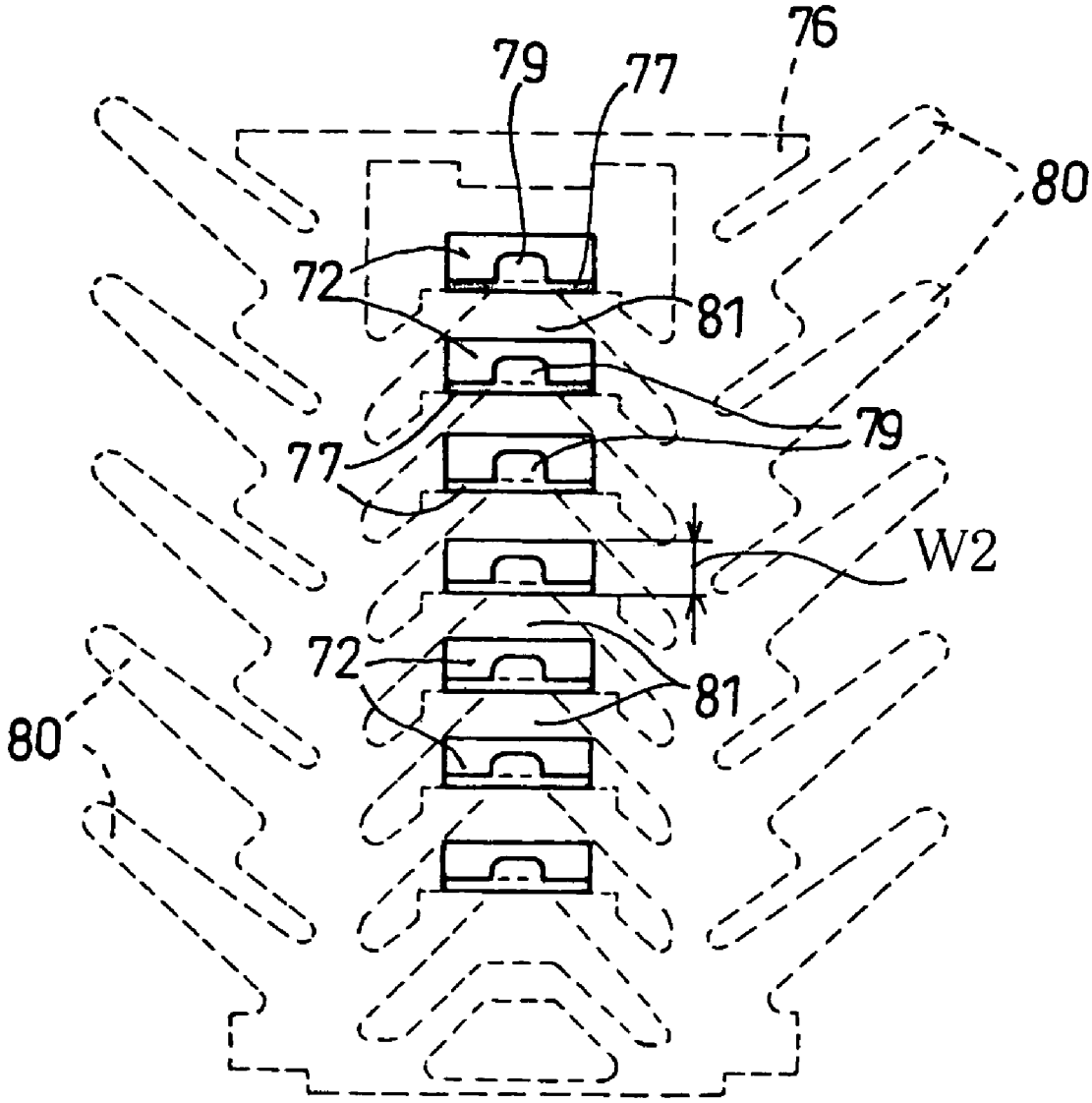
FIG. 14 is a view taken along 14, 14 in FIG. 9.

Next, the inclined sheet-separate plate 8 and the sheet-separate body 11 will be described. As shown in FIGS. 13 and 14, the sheet-separate body 11 is constituted by an elongate serrate elastic body (e.g., a metallic plate spring). The sheet-separate body 11 includes a flat base portion 76; and an array of arm portions 77 that are formed by cutting a plurality of inner portions of the base portion 86 and bending the cut inner portions upward. Each of the arm portions 77 has, as a free end portion thereof, a sheet-separate top portion 79 that has a generally V-shaped cross section and is inclined obliquely upward. In addition, the sheet-separate body 11 includes a plurality of elastic legs 80 that are formed along two long sides of the flat base portion 76 such that the elastic legs 80 are inclined obliquely downward. The elastic legs 80 can cooperate with each other to give an elastic force (or a biasing force) to the sheet-separate body 11. Thus, the sheet-separate body 11 can be easily formed by, e.g., stamping a metallic plate and bending appropriate portions of the thus obtained metallic plate.

As shown in FIGS. 4, 5A, 5B, 6, and 7, the inclined sheet-separate plate 8 is detachably attached to the rear end of the sheet cassette 3 (i.e., the right-hand end in FIG. 4). Each of the sheet-separate body 11 and the cassette 3 is formed by injection molding of synthetic resin. The inclined sheet-separate plate 8 is constituted by a single continuous plate. The sheet-separate plate 8 has a convexly curved shape in its plan view in which a middle portion of the plate 8 in a widthwise direction of each recording sheet P, i.e., the Y direction, swells toward the bottom plate 31, and opposite end portions of the plate 8 in the Y direction do not swell. The elastic sheet-separate body 11 is attached to the middle portion of the sheet-separate plate 8, from the rear side of the plate 8. Thus, the sheet-separate body 11 engages, on the front side of the sheet-separate plate 8, a leading end of each recording sheet P to promote separation of the each sheet P from the other sheets P.

A rear or back surface of the inclined sheet-separate plate 8 is supported by a plurality of back-surface support portions 71 (FIG. 4) each having a trapezoidal or triangular shape in its side view. The inclined sheet-separate plate 8 has a length greater than all the respective widths of the various sizes of recording sheets P. The back-surface support portions 71 are provided in front of a rear plate 70 of the sheet cassette 3, such that the support portions 71 are distant from each other by respective appropriate distances in the Y direction. Each of the back-surface support portions 71 has an engaging groove, not shown, that extends from an upper end thereof in a downward direction. The inclined sheet-separate plate 8 has, in the back surface thereof, a plurality of engaging claws 73 each of which is formed integrally with the remaining portion of the sheet-separate plate 8 and can engage the engaging groove 42 of a corresponding one of the back-surface support portions 71. An enveloping surface that envelopes respective front inclined surfaces of the back-surface support portions 71 that are opposed to the back surface of the inclined sheet-separate plate 8 is convexly curved such that a middle portion of the enveloping surface in the widthwise direction of each recording sheet P projects from opposite end portions thereof toward the recording sheets P placed on the bottom plate 31. Therefore, in the state in which the engaging claws 73 are engaged with the respective engaging grooves of the back-surface support portions 71, the back surface of the inclined sheet-separate plate 8 having the convexly curved shape whose middle portion in the Y direction swells toward the bottom plate 31, is supported by the respective front inclined surfaces of the back-surface support portions 71.

Figure 6:
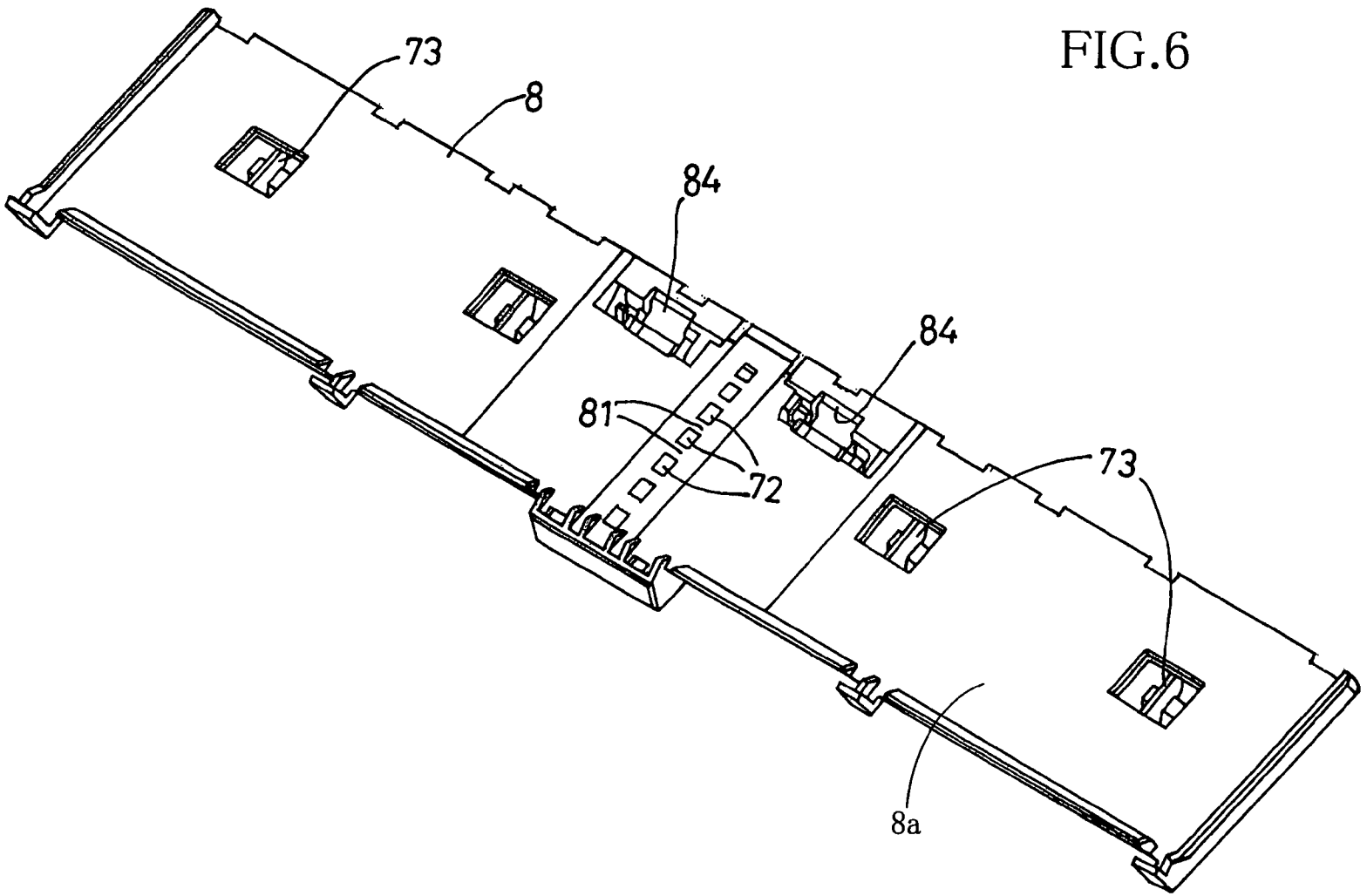
FIG. 6 is a perspective view of a front surface (i.e., sheet-guide surface) of an inclined sheet-separate plate of the sheet cassette.
Figure 7:
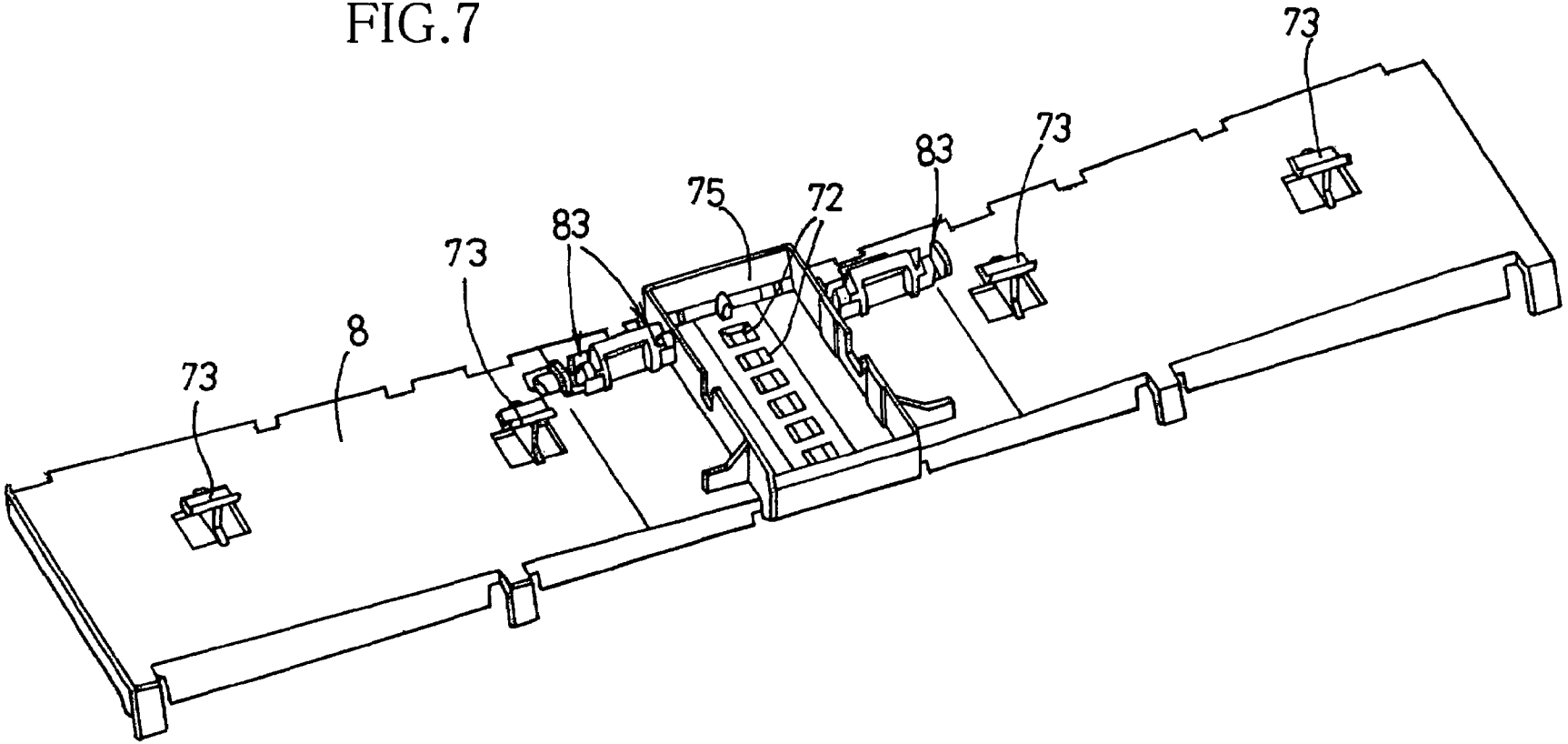
FIG. 7 is a perspective view of a rear surface of the inclined sheet-separate plate.
Figure 9:
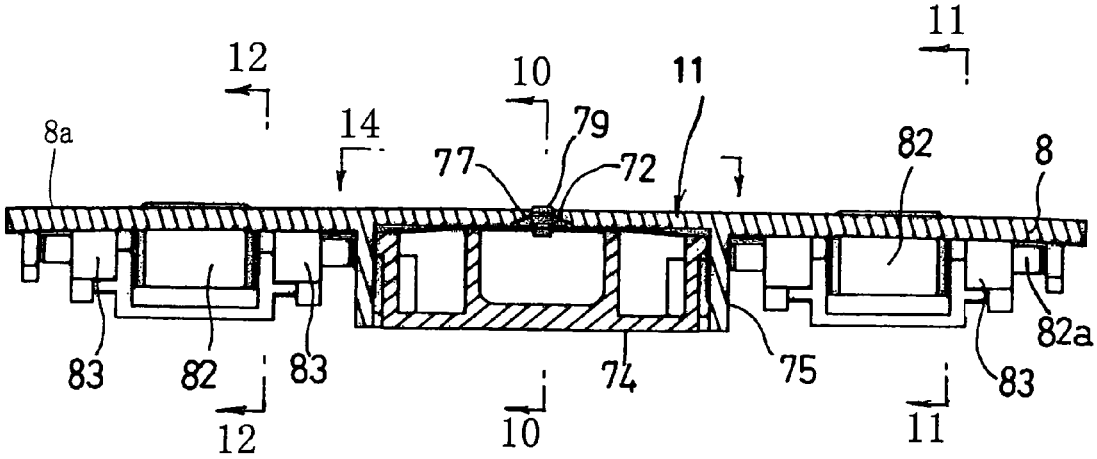
FIG. 9 is an enlarged cross-sectional view, taken along 9, 9 in FIG. 8.
Figure 10:
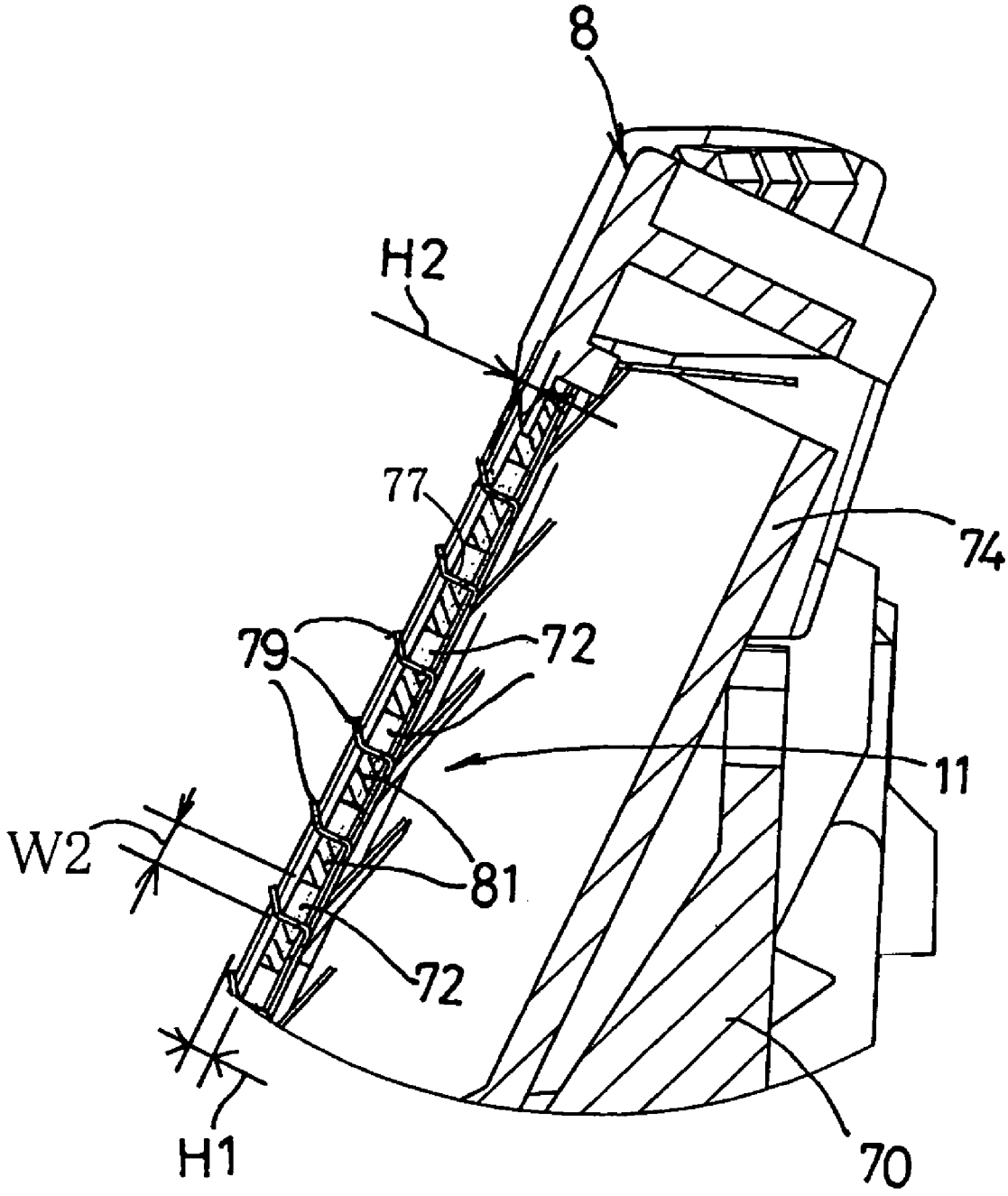
FIG. 10 is an enlarged cross-sectional view, taken along 10, 10 in FIG. 8 or FIG. 9.

In addition, as shown in FIGS. 6, 7, and 10, the inclined sheet-separate plate 8 has, in a middle portion thereof in a lengthwise direction thereof (i.e., the Y direction or the widthwise direction of the sheet cassette 3), a plurality of window holes 72 through which the arm portions 77 or sheet-separate top portions 79 of the sheet-separate body 11, attached to the back surface of the sheet-separate plate 8, project into the front side of the same 8. The window holes 72 are arranged in an array in an obliquely upward direction from the bottom plate 31, and are distant from each other at an appropriate interval of distance that is substantially equal to that at which the arm portions 77 or sheet-separate top portions 79 of the sheet-separate body 11 are distant from each other. Therefore, the sheet-separate plate 8 has, as integral portions thereof, a plurality of connection portions 81 provided among the window holes 72. Moreover, as shown in FIGS. 9 and 10, the inclined sheet-separate plate 8 has, on the back surface thereof, an attachment case (i.e., a holder case) 75 that is formed integrally with the remaining portion of the sheet-separate plate 8, surrounds all the window holes 72, and accommodates a box-like support member 74. The support member 74 is formed of a synthetic resin, and supports the sheet-separate body 11.

Thus, the inclined sheet-separate plate 8 is obtained in such a manner that first the sheet-separate body 11 is inserted into the attachment case 75 from the rear side of the plate 8, subsequently the arm portions 77 are fitted in the window holes 72, respectively, and then the support member 74 is fixed to the case 75. In this state, all the elastic legs 80 of the sheet-separate body 11 are supported by the support member 74. Thus, as shown in FIGS. 9 and 10, the flat base portion 76 is held in close contact with the back surface of the sheet-separate plate 8 and the sheet-separate top portions 79 project by respective pre-selected amounts into the front side of the plate 8.

From the above-indicated state, if the inclined sheet-separate plate 8 is moved downward by a person toward the back-surface support portions 71 provided in front of the rear plate 70 of the sheet cassette 3, such that the engaging claws 73 provided on the back surface of the plate 8 engage the respective engaging grooves of the support portions 71, and such that the back surface of the plate 8 are contacted with the respective inclined front surfaces of the support portions 71, then a front surface (i.e., a sheet-guide surface) 8*a* of the plate 8 that guides the movement of each recording sheet P is also convexly curved like an arc, in its plan view, such that a middle portion of the front surface 8*a* in the widthwise direction of each recording sheet P projects from opposite end portions thereof toward the recording sheets P placed on the bottom plate 31. Therefore, the inclined sheet-separate plate 8 receives a maximum bending stress and a maximum flexural deformation in the lengthwise middle portion thereof where the window holes 72 are formed. However, in the present embodiment, the sheet-separate plate 8 does not have a single elongate window hole that surrounds all the arm portions 77 or the sheet-separate top portions 79, but the plate 8 has the connection portions 81 that are provided among the small window holes 72 and can contribute to increasing a rigidity of the lengthwise middle portion of the plate 8. Therefore, the sheet-separate plate 8 is not warped to such an extent that the lengthwise middle portion of the plate 8, including the connection portions 81 provided among the window holes 72, largely projects toward the front side of the plate 8. Thus, the sheet-separate plate 8 can stably support the sheet-separate body 11, such that the sheet-separate top portions 79 project by just the respective designed amounts into the front side of the plate 8. Therefore, the sheet-separate body 11 can reliably separate each one of the recording sheets P from the other sheets P, so that the recording sheets P may be separated and fed forward, one by one.

Meanwhile, the metal-based, sheet-separate body 11 has a generally rectangular shape that is elongate in the obliquely upward direction along the front surface 8*a* of the inclined sheet-separate plate 8, and two lengthwise opposite end portions of the body 11 are bent downward. Therefore, the sheet-separate top portions 79 supported by the lengthwise opposite end portions of the sheet-separate body 11 are less deformable than the sheet-separate top portions 79 supported by a lengthwise middle portion of the same 11. Here, in the case where the sheet cassette 3 is formed so deep as to be able to accommodate a great number of glossy sheets (as a sort of recording sheets P) that are suitable for recording of photographic images, and in a special state in which only a small number of glossy sheets are currently left in the cassette 3, it is assumed that the top glossy sheet is fed to the curved sheet guide 9, i.e., the U-turn path having a small radius of curvature. Since, however, the glossy sheet is hard as a whole and accordingly a trailing end portion of the sheet is too hard to deform and follow the U-turn path, the sheet tends to return to its original, planar shape, so that the sheet may strongly engage the highest sheet-separate top portion 79 only. In this case, a surface (i.e., a recording surface) of the glossy sheet may be damaged.

In the present embodiment, an amount, H1, of projection of the lowest sheet-separate top portion 79 (FIG. 10) is greater than an amount, H2, of projection of the highest sheet-separate top portion 79, that is, the projection amount H2 is smaller than the projection amount H1. Therefore, even if the recording sheets P may be glossy sheets that are considerably hard, a trailing end portion of each of the sheets P contacts only respective small areas of the sheet-separate top portions 79, so that the recording surface of the each sheet P may be prevented from being damaged.

One or more higher arm portions 77 may be smaller or thinner than one or more lower arm portions 77, so that the higher arm portions 77 or the higher sheet-separate top portions 79 may be less rigid or elastic than the lower arm portions 77 or the lower sheet-separate top portions 79. In this case, even if a hard recording sheet P may engage the higher sheet-separate top portions 79, those higher sheet-separate top portions 79 can be more easily flexed and accordingly the surface of the recording sheet P can be more effectively prevented from being damaged.

Figure 8:
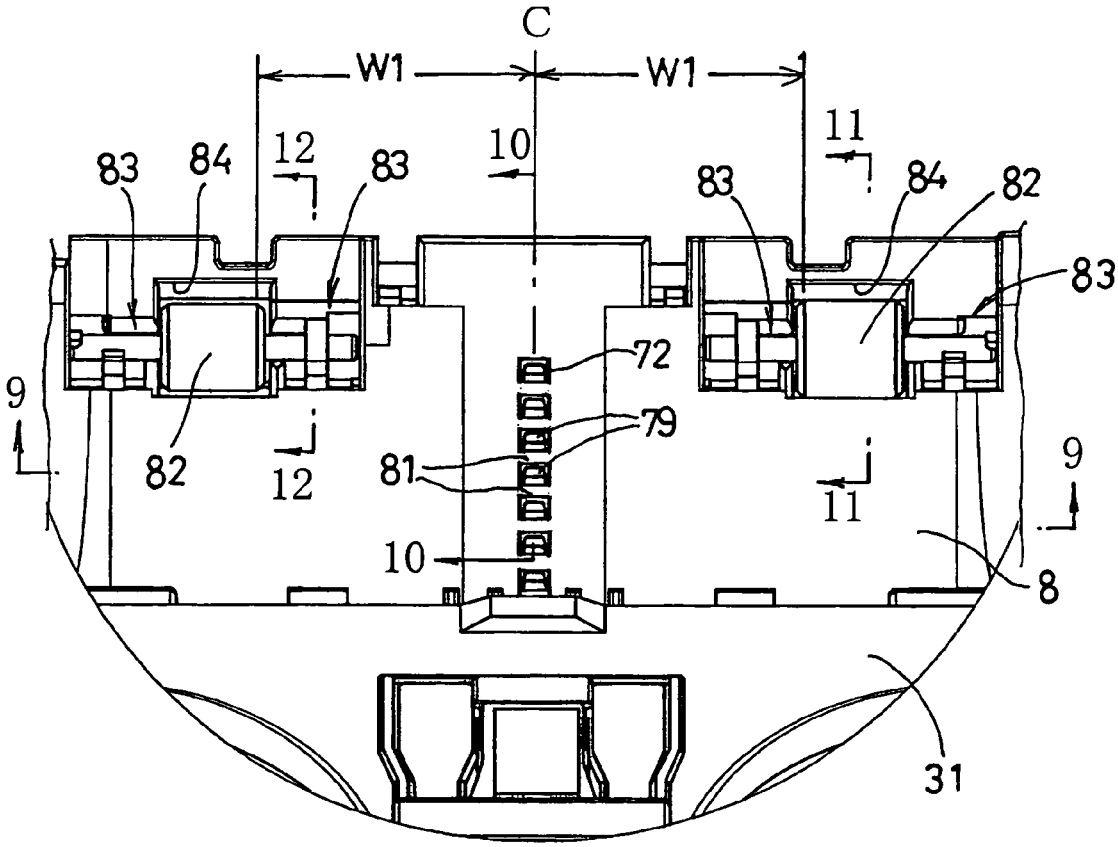
FIG. 8 is an enlarged front view of an essential portion of the inclined sheet-separate plate.

In addition, in the present embodiment, the inclined sheet-separate plate 8 has, at the substantially same height position as the height position where the highest sheet-separate top portion 79 is located, and at respective positions on either side of the highest top portion 79 (i.e., on either side of the attachment case 75 in the widthwise direction of the sheet cassette 3), two attachment holes 84 which are formed through a thickness of the plate 8 and in which two freely rotatable assist rollers 82, formed of synthetic resin, are provided, respectively, so as to feed more smoothly each recording sheet P, as shown in FIGS. 6, 7, 8, and 11. The sheet-separate plate 8 has, in the back surface thereof, two bearing portions 83 that support respective axis portions 82*a* of the two assist rollers 82 such that the rollers 82 are freely rotatable, as shown in FIGS. 7, 8, and 9. A height position of an upper end of the sheet-separate plate 8 is adjacent to a portion of the curved sheet guide 9 where the direction of movement of each recording sheet P is reversed. The highest sheet-separate top portion 79 is located at the height position adjacent to the upper end of the inclined sheet-separate plate 8. Thus, the two assist rollers 82 are located at the substantially same height position as the height position where the highest sheet-separate top portion 79 is located.

Figure 11:
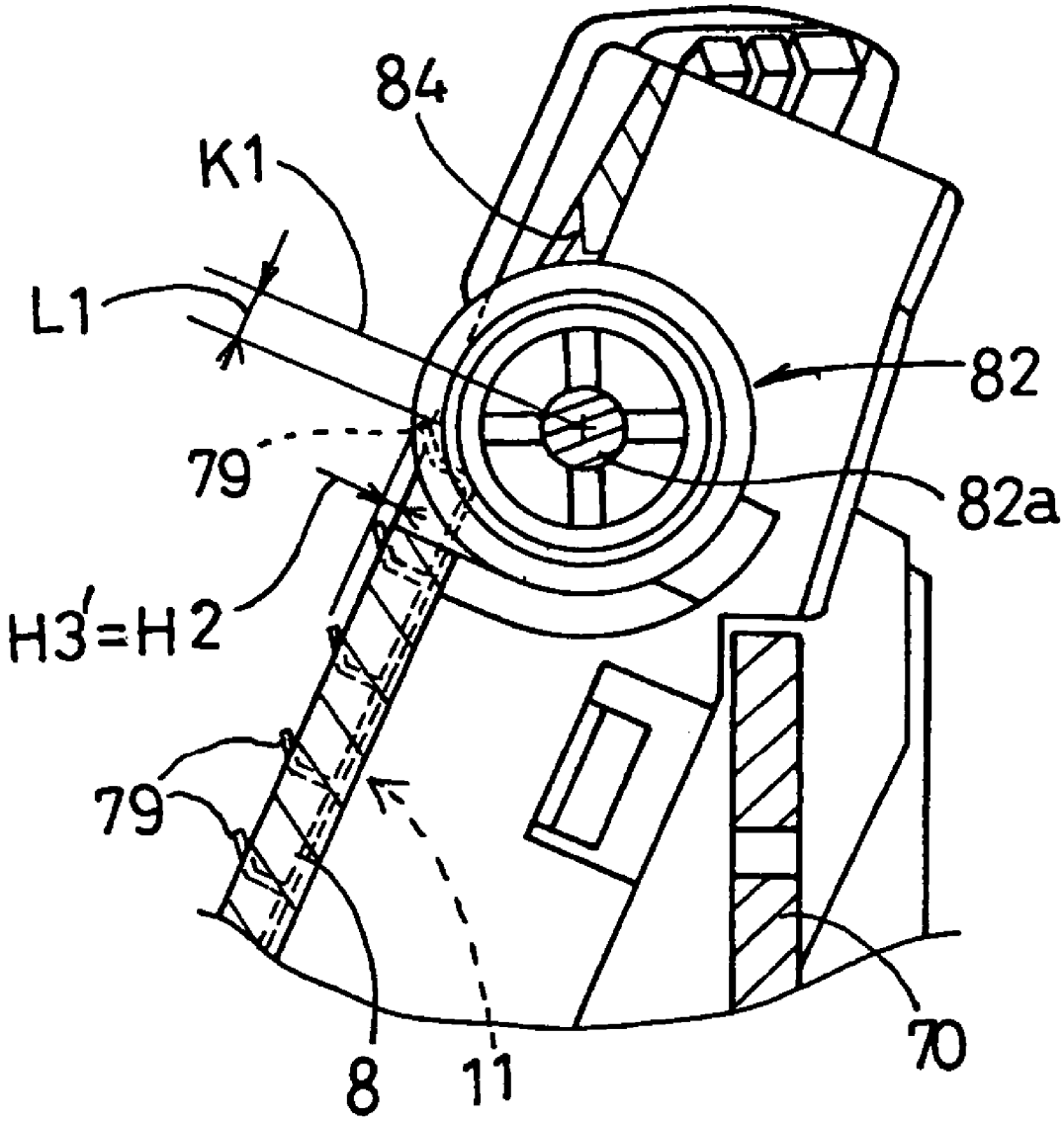
FIG. 11 is an enlarged cross-sectional view, taken along 11, 11 in FIG. 8 or FIG. 9.
Figure 12:
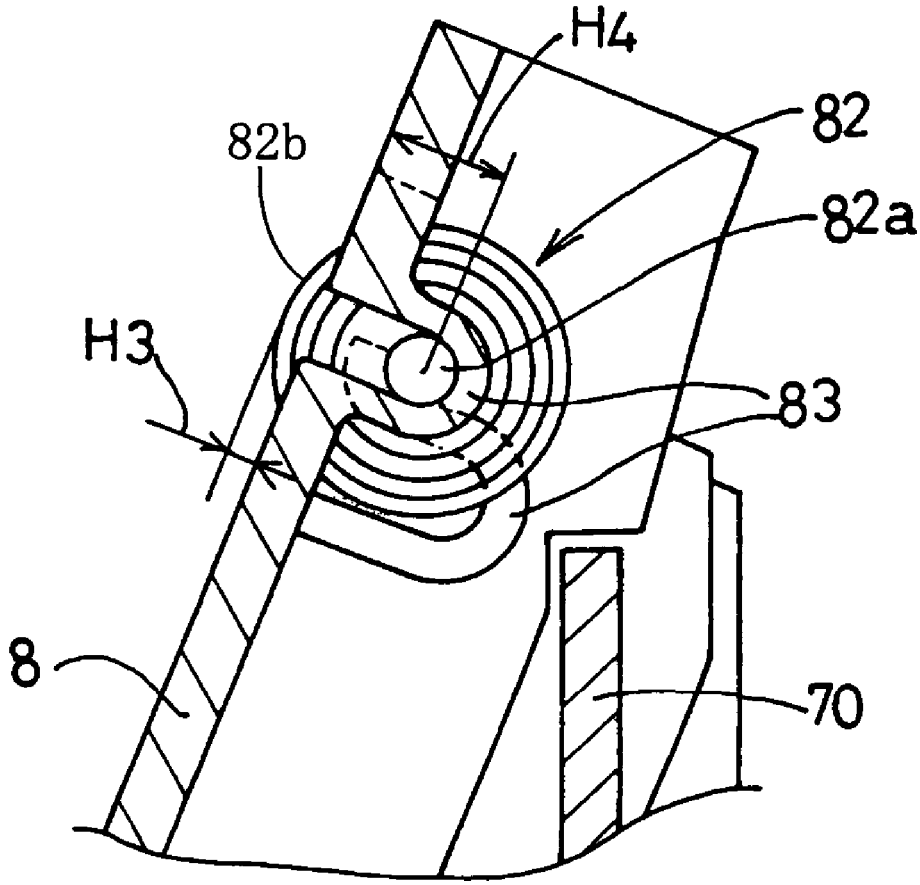
FIG. 12 is an enlarged cross-sectional view, taken along 12, 12 in FIG. 8 or FIG. 9.

As shown in FIGS. 11 and 12, the two assist rollers 82 are rotatably supported by the two bearing portions 83, respectively, such that a portion of an outer cylindrical surface of each of the rollers 82 projects frontward from the front surface 8*a* of the inclined sheet-separate plate 8. A maximum amount, H3, of projection of the outer cylindrical surface of the each assist roller 82 from the front surface 8*a* of the sheet-separate plate 8 is somewhat greater than the amount H2 of projection of the upper end (i.e., free end) of the highest sheet-separate top portion 79 from the front surface 8*a* of the sheet-separate plate 8. In addition, the free end of the highest sheet-separate top portion 79 is distant, by a predetermined distance, L1, in an obliquely downward direction along the front surface 8*a* of the sheet-separate plate 8, from a straight line, K1, which perpendicularly intersects a centerline of the axis portion 82*a* of the each assist roller 82, i.e., an axis line of rotation of the each roller 82 and which is normal to the front surface 8*a* of the plate 8. Therefore, as shown in FIG. 11 that is a side elevation view of the sheet-separate plate 8, an amount, H3', of projection of a portion of the outer cylindrical surface of the each assist roller 82 that corresponds to the free end of the highest sheet-separate top portion 79, is somewhat smaller than the maximum projection amount H3. In the present embodiment, the projection amount H3' is substantially equal to, or somewhat greater than, the amount H2 of projection of the free end of the highest sheet-separate top portion 79. That is, the projection amount H2 is substantially equal to, or somewhat smaller than, the projection amount H3'.

Therefore, in the present embodiment, the assist rollers 82 can prevent, when the sheet-feed roller 6*b* feeds each recording sheet P while cooperating with the inclined sheet-separate plate 8 and the curved sheet guide 9 to reverse the direction of movement of the each sheet P, the each sheet P from being excessively flexed because of the conveying force applied by the sheet-feed roller 6*b* to the each sheet P, or can prevent a trailing end portion of the each sheet P from being strongly pressed against the highest sheet-separate top portion 79. The trailing end portion of each recording sheet P means a portion of the sheet P that has a length up to from about 20 mm to about 40 mm as measured from the trailing end thereof. Therefore, the respective surfaces of the recording sheets P, such as glossy sheets, can be effectively prevented from being damaged, and accordingly the quality of images recorded on the sheets P can be prevented from being lowered.

Figure 15:
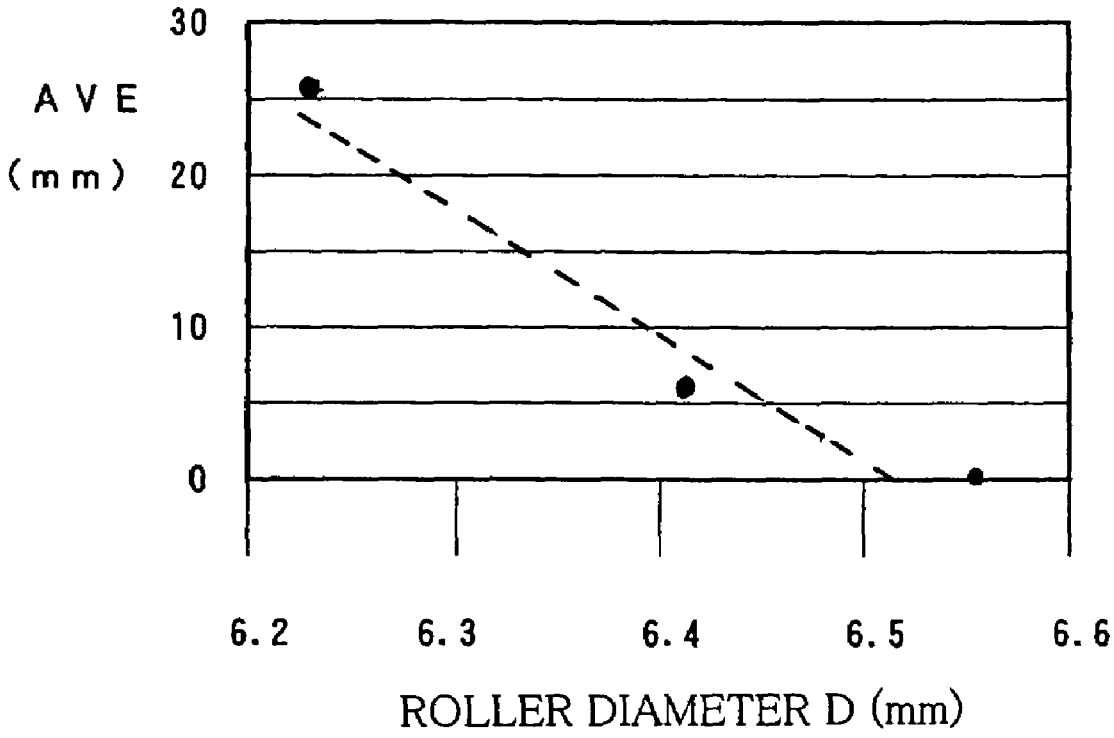
FIG. 15 is a graph showing experimental results.

FIG. 15 shows experimental results. This experiment was carried out under the following conditions: A radius of curvature of the inclined sheet-separate plate 8 when the plate 8 is attached to the sheet cassette 3 is about 1,600 mm; a distance, W1 (FIG. 8), between a center, C, of the sheet-separate plate 8 as seen in the lengthwise direction thereof and an inner one of axially opposite ends of each of the two assist rollers 82 is about 19.1 mm; a distance, H4 (FIG. 12), between the front surface of the sheet-separate plate 8 and each of the two bearing portions 83 is about 2.875 mm; the above-described predetermined distance L1 (FIG. 11) is about 1.13 mm; and the above-described projection amount H2 (FIG. 10) is about 0.24 mm. In the experiment, five A4-size exclusive glossy sheets and five L-size exclusive glossy sheets were used with each of different assist rollers 82 having different diameters, D, and an average, AVE, of respective scars occurring to the ten glossy sheets corresponding to each assisting roller 82 was obtained.

The obtained experimental results show that when the diameter D of assist roller 82 is 6.23 mm, the average AVE of scars is 26.8 mm; when the diameter D of assist roller 82 is 6.41 mm, the average AVE of scars is 5.5 mm; and when the diameter D of assist roller 82 is 6.56 mm, the average AVE of scars is 0 mm.

Thus, in the present embodiment, the two assist rollers 82 are respectively provided on either side of the highest sheet-separate top portion 79 provided in the lengthwise middle portion of the inclined sheet-separate plate 8; and each assist roller 82 is given a considerably large diameter (i.e., outer diameter) and is located at an appropriate position. More specifically described, in the side elevation view of the sheet-separate plate 8, the amount H3' of projection of the portion of the outer cylindrical surface of the each assist roller 82 that has, in the obliquely upward direction along the sheet-guide surface 8*a*, the same position as that of the free end of the highest sheet-separate top portion 79, is substantially equal to, or somewhat greater than, the amount H2 of projection of the free end of the highest sheet-separate top portion 79. That is, the projection amount H2 is substantially equal to, or somewhat smaller than, the projection amount H3'. The projection amount H3' is of a specific portion of the outer cylindrical surface of the each assist roller 82 where the amount of projection of the outer cylindrical surface from the front surface 8*a* of the sheet-separate plate 8 gradually increases. At this specific portion of the outer cylindrical surface of the each assist roller 82, each recording sheet P slides on the outer cylindrical surface of the each roller 82, while a blank surface (i.e., a recording surface) of the each sheet P moves in a direction away from the front surface 8*a* of the sheet-separate plate 8. Thus, the recording surface of the each sheet P is effectively prevented from being excessively strongly engaged with the highest sheet-separate top portion 79. That is, each recording sheet P can be reliably separated from the remaining recording sheets P, while the blank surface (recording surface) of the each sheet P can be effectively prevented from being damaged.

As shown in FIGS. 10 and 14, when each recording sheet P engages each of the arm portions 77 provided in the respective window holes 72, i.e., each of the sheet-separate top portions 79, the each arm portion 77 or the each top portion 79 needs to be elastically flexed or deformed downward, i.e., toward the rear side of the sheet-separate plate 8, so as to allow the each sheet P to be fed forward. To this end, the sheet-separate body 11 is attached to the sheet-separate plate 8, such that there is left a space having a predetermined dimension, W2, between each of the arm portions 77 and an upper one of opposed inner walls of a corresponding one of the window holes 72. Owing to the structural feature that each sheet-separate top portion 79 is allowed to be flexed downward, each recording sheet P can be fed forward while it is reliably separated from the remaining recording sheets P. In addition, the sheet-separate body 11 is attached to the sheet-separate plate 8, such that each of the arm portions 77 that are bent upward from the flat base portion 76 is held in contact with a lower one of the opposed inner walls of a corresponding one of the window holes 72. Owing to this structural feature, each arm portion 77 can be effectively prevented from being flexed in the obliquely downward direction along the front surface 8*a*, and accordingly the arm portions 77 and the sheet-separate top portions 79 can be reinforced without adversely affecting the sheet-separation performance of the sheet-separate body 11. Moreover, when the sheet cassette 3 accommodates a great number of recording sheets P in a stacked state, this structure feature contributes to preventing the arm portions 77 from being accidentally deformed by abrupt pressing of the respective end portions of the cording sheets P on the sheet-separate top portions 79.

As described above, the inclined sheet-separate plate 8 is formed independent of the sheet cassette 3. Therefore, the sheet-separate body 11 can be easily attached to the sheet-separate plate 8, from the rear side of the plate 8. Thus, the present sheet supplying portion or apparatus can be easily assembled.

In the illustrated embodiment, the single sheet cassette 3 is employed. However, the principle of the present invention is applicable to such an image recording apparatus that employs a plurality of sheet cassettes that are provided in an upper portion and a lower portion of the image recording apparatus 1, respectively. Moreover, in the illustrated embodiment, the inclined sheet-separate plate 8 has the plurality of window holes 72 arranged in the obliquely upward direction. However, the principle of the present invention is applicable to such an inclined sheet-separate plate having a single window hole elongate in the same direction, so that the plurality of sheet-separate top portions 79 can project altogether into the front side of the sheet-separate plate through the elongate window hole.

The principle of the present invention is also applicable to such a sheet supplying apparatus that does not employ any sheet cassettes 3 but employs one or more sheet trays that are not removable from the sheet supplying apparatus. The sheet tray or trays may be one or more fixed sheet trays that is fixed to a housing of the apparatus, or one or more movable sheet trays that is movable relative to a housing of the apparatus.

In the illustrated embodiment, the two assist rollers 82 are provided on either side of the sheet-separate body 11 in the widthwise direction of the sheet cassette 3 as the sheet holder. However, the principle of the present invention is also applicable to such a sheet supplying apparatus or a sheet cassette that employs an inclined sheet-separate plate 8 that supports two sheet-separate bodies 11 extending parallel to each other in an obliquely upward direction along a front surface 8*a* of the plate 8 and additionally supports a single assist roller 82 as a projecting portion that is provided between the two sheet-separate bodies 11.

It is to be understood that the present invention may be embodied with various changes, modifications, and improvements that may occur to a person skilled in the art without departing from the spirit and scope of the invention defined in the appended claims.

What is claimed is:

1. A sheet supplying apparatus, comprising:

a sheet holder which has a bottom wall and accommodates a plurality of recording sheets stacked on each other on the bottom wall;

a sheet feeding device which feeds an uppermost one of the stacked recording sheets in a sheet-feed direction;

an inclined guide plate which is provided downstream of the sheet holder in the sheet-feed direction, wherein the inclined guide plate has a sheet-guide surface which is configured to directly contact at least one of the recording sheets and which guides a movement of each of the recording sheets while changing a direction of said movement;

a sheet-separate body with which the sheet feeding device cooperates to separate and feed the recording sheets, one by one, wherein the sheet-separate body is supported by the inclined guide plate, and includes a plurality of sheet-separate portions which are arranged in the sheet-feed direction and which project from a plurality of portions of the sheet-guide surface of the inclined guide plate; and at least one projecting portion which is supported by the inclined guide plate, at at least one position distant from the sheet-separate body in a widthwise direction of the sheet holder, and which has a curved surface projecting from the sheet-guide surface of the inclined guide plate, wherein a height by which an upstream-side portion of the curved surface of said at least one projecting portion with respect to the sheet-feed direction projects from the sheet-guide surface of the inclined guide plate gradually increases in the sheet-feed direction.

2. The sheet supplying apparatus according to claim 1, further comprising a curved sheet guide which is provided downstream of the inclined guide plate and which guides the movement of said each recording sheet, while cooperating with the sheet feeding device and the inclined guide plate to change the direction of the movement of said each recording sheet.

3. A recording apparatus, comprising:

the sheet supplying apparatus according to claim 2; and a recording device which records an image on each of the recording sheets.

4. The recording apparatus according to claim 3, further comprising two register rollers which are provided on a downstream side of the curved sheet guide in an opposite direction opposite to the sheet-feed direction and which cooperate with each other to convey said each recording sheet to the recording device.

5. The recording apparatus according to claim 3, wherein a downstream end of the inclined guide plate in the sheet-feed direction is located adjacent to a portion of the curved sheet guide where the direction of movement of said each recording sheet is reversed, and wherein a most downstream one of the sheet-separate portions in the sheet-feed direction is provided at a position adjacent to the downstream end of the inclined guide plate.

6. The sheet supplying apparatus according to claim 1, wherein a most downstream one of the sheet-separate portions in the sheet-feed direction is provided at a position adjacent to a downstream end of the inclined guide plate, and wherein said at least one projecting portion is provided, in the sheet-feed direction, at a position substantially equal to the position of the most downstream sheet-separate portion.

7. The sheet supplying apparatus according to claim 1, wherein the sheet supplying apparatus comprises a sheet cassette which is detachably set in the sheet supplying apparatus, and wherein the sheet cassette includes the sheet holder.

8. The sheet supplying apparatus according to claim 1, comprising at least two said projecting portions which are supported by the inclined guide plate, at at least two positions including two positions on either side of the sheet-separate body in the widthwise direction of the sheet holder.

9. The sheet supplying apparatus according to claim 1, wherein said at least one projecting portion comprises at least one roller having a cylindrical outer surface which partially projects, as the curved surface, from the sheet-guide surface of the inclined guide plate.

10. The sheet supplying apparatus according to claim 9, wherein a free end of a most downstream one of the sheet-separate portions in the sheet-feed direction is distant, upstream with respect to the sheet-feed direction, from a straight line which perpendicularly intersects an axis line of rotation of said at least one roller and which is normal to the sheet-guide surface of the inclined guide plate, and the free end of the most downstream sheet-separate portion is located adjacent to the cylindrical outer surface of said at least one roller.

11. The sheet supplying apparatus according to claim 1, wherein the inclined guide plate has a plurality of window holes each of which extends in the widthwise direction of the sheet holder and through which the sheet-separate portions of the sheet-separate body project, respectively, from a rear side of the inclined guide plate to a front side thereof; and at least one connection portion which is located between the window holes so as to connect between two portions of the inclined guide plate that are located on either side of the window holes and which increases a rigidity of the inclined guide plate.

12. The sheet supplying apparatus according to claim 1, wherein the sheet-separate body comprises a metallic sheet including a flat base portion;

a plurality of arm portions extending from the base portion;

the plurality of sheet-separate portions which are bent from the arm portions, respectively, and which contact, at respective free ends thereof, said each recording sheet; and a plurality of elastic portions extending from the base portion on one of opposite sides thereof that is opposite to an other side thereof on which the sheet-separate portions are bent from the arm portions, respectively.

13. The sheet supplying apparatus according to claim 12, wherein the inclined guide plate has a plurality of window holes each of which extends in the widthwise direction of the sheet holder and through which the arm portions of the sheet-separate body project, respectively, from a rear side of the inclined guide plate to a front side thereof, and wherein an upstream one of opposed surfaces of said each window hole that are opposed to each other in the sheet-feed direction prevents a corresponding one of the arm portions from being flexed upstream with respect to the sheet-feed direction.

14. The sheet supplying apparatus according to claim 1, wherein the inclined guide plate has a plurality of window holes each of which extends in the widthwise direction of the sheet holder and through which the sheet-separate portions project, respectively, from a rear side of the inclined guide plate to a front side thereof, and wherein a height by which a most downstream one in the sheet-feed direction of the sheet-separate portions projects from a corresponding one of the window holes is smaller than an amount by which an upstream one of the sheet-separate portions that is located upstream of the most downstream sheet-separate portion projects from a corresponding one of the window holes.

15. The sheet supplying apparatus according to claim 1, wherein the inclined guide plate is attached to the sheet holder such that the inclined guide plate is detachable from the sheet holder.

16. A sheet supplying apparatus, comprising:

a sheet holder which has a bottom wall and accommodates a plurality of recording sheets stacked on each other on the bottom wall;

a sheet feeding device which feeds an uppermost one of the stacked recording sheets in a sheet-feed direction;

an inclined guide plate which is provided downstream of the sheet holder in the sheet-feed direction, wherein the inclined guide plate has a sheet-guide surface which is configured to directly contact at least one of the recording sheets and which guides a movement of each of the recording sheets while changing a direction of said movement;

a sheet-separate body with which the sheet feeding device cooperates to separate and feed the recording sheets, one by one, wherein the sheet-separate body is supported by the inclined guide plate, and includes a plurality of sheet-separate portions which are arranged in the sheet-feed direction and which project from a plurality of portions of the sheet-guide surface of the inclined guide plate; and at least one projecting portion which is supported by the inclined guide plate, at at least one position distant from the sheet-separate body in a widthwise direction of the sheet holder, and which has a curved surface projecting from the sheet-guide surface of the inclined guide plate, wherein a maximal height by which the curved surface of said at least one projecting portion projects from the sheet-guide surface of the inclined guide plate is not smaller than a height by which a most downstream one in the sheet-feed direction of the sheet-separate portions of the sheet-separate body projects from the sheet-guide surface.

17. The sheet supplying apparatus according to claim 16, wherein the maximal height of the curved surface of said at least one projecting portion is not greater than twice the height of the most downstream sheet-separate portion of the sheet-separate body.

18. The sheet supplying apparatus according to claim 16, wherein the maximal height of the curved surface is greater than the height of the most downstream sheet-separate portion.

19. A sheet cassette for accommodating a plurality of recording sheets stacked on each other, comprising:

a bottom wall on which the recording sheets are stacked on each other;

an inclined guide plate provided at a downstream end of the sheet cassette in a sheet-feed direction in which each of the recording sheets is fed by a sheet feeding device, wherein the inclined guide plate is inclined upward from the bottom wall, and wherein the inclined guide plate has a sheet-guide surface which is configured to directly contact at least one of the recording sheets and which guides a movement of said each recording sheet while changing a direction of said movement to an obliquely upward direction;

a sheet-separate body which is supported by the inclined guide plate and includes a plurality of sheet-separate portions which are arranged in the obliquely upward direction and which project from a plurality of portions of the sheet-guide surface of the inclined guide plate that have different height positions; and at least one projecting portion which is supported by the inclined guide plate, at at least one position distant from the sheet-separate body in a widthwise direction of the sheet cassette, and which has a curved surface projecting from the sheet-guide surface of the inclined guide plate, wherein a height by which an upstream-side portion of the curved surface of said at least one projecting portion with respect to the sheet-feed direction projects from the sheet-guide surface of the inclined guide plate gradually increases in the sheet-feed direction.

* * * * *